US006466913B1

(12) United States Patent
Yasuda et al.

(10) Patent No.: US 6,466,913 B1
(45) Date of Patent: Oct. 15, 2002

(54) METHOD OF DETERMINING A SOUND LOCALIZATION FILTER AND A SOUND LOCALIZATION CONTROL SYSTEM INCORPORATING THE FILTER

(75) Inventors: Seigou Yasuda, Kanagawa; Masao Kasuga, Tochigi, both of (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 09/346,055

(22) Filed: Jun. 29, 1999

(30) Foreign Application Priority Data

Jul. 1, 1998 (JP) ..... 10-201190

(51) Int. Cl.[7] ..... G10L 19/00
(52) U.S. Cl. ..... 704/500; 704/270
(58) Field of Search ..... 704/500, 270, 704/200; 381/1, 2, 17, 19, 20, 61, 300–309

(56) References Cited

U.S. PATENT DOCUMENTS

| | | | | |
|---|---|---|---|---|
| 4,188,504 A | | 2/1980 | Kasuga et al. | |
| 5,581,618 A | * | 12/1996 | Satoshi et al. | 381/17 |
| 5,661,813 A | * | 8/1997 | Shimauchi et al. | 381/66 |
| 5,694,474 A | * | 12/1997 | Ngo et al. | 381/66 |
| 5,715,317 A | * | 2/1998 | Nakazawa | 381/17 |
| 5,812,685 A | * | 9/1998 | Fujita et al. | 381/24 |
| 5,943,427 A | * | 8/1999 | Massie et al. | 381/17 |
| 6,002,776 A | * | 12/1999 | Bhadkamkar et al. | 381/66 |
| 6,078,669 A | * | 6/2000 | Maher | 381/17 |
| 6,173,061 B1 | * | 1/2001 | Norris et al. | 381/309 |
| 6,243,476 B1 | * | 6/2001 | Gardner | 381/303 |
| 6,246,760 B1 | * | 6/2001 | Makino et al. | 379/410 |
| 6,285,766 B1 | * | 9/2001 | Kumamoto | 381/17 |
| 6,307,941 B1 | * | 10/2001 | Tanner, Jr. et al. | 381/17 |

FOREIGN PATENT DOCUMENTS

| | | |
|---|---|---|
| JP | 2298200 | 12/1990 |
| JP | 5252598 | 9/1993 |
| JP | 6245300 | 9/1994 |

OTHER PUBLICATIONS

Odell et al, "A Versatile Integrated Acoustic Beamforming System", pp. 635–638, IEEE 1991.*

Hasegawa, "Binaural Sound Reproduction Using Head Related Transfer Functions Approximated by IIR Filters", 1999 IEEE.*

"A Study on Clustering Method of Sound Localization Transfer Functions" The Institute of Electronics, Information and Communication Engineers, S. Shimada et al., Technical Report of IEICE, EA 93–I (Apr. 1993), pp. 1–7.

"Design and Test of IIR Filter with Complex Frequency Characteristics" Miyauchi et al., Transactions of the Japanese Acoustics Association, 3–3–2, Mar. 1997 pp. 571–572.

"IIR Filter Design", H. Ochi, Interface, Nov., 1996 pp. 206–213.

* cited by examiner

*Primary Examiner*—Richemond Dorvil
*Assistant Examiner*—Michael N. Opsasnick
(74) *Attorney, Agent, or Firm*—Cooper & Dunham LLP

(57) ABSTRACT

A method of determining a sound localization filter for approximation of a head related transfer function. The method comprises storing a plurality of sets of initial parameters with respect to a plurality of predetermined direction angles about a front position of a listener into a memory, reading one of the sets of initial parameters from the memory in accordance with a localization shift signal, calculating an optimum filter parameter based on the read initial parameters, the optimum filter parameter needed to approximate desired frequency characteristics of the head related transfer function, determining filter coefficients of the sound localization filter based on the optimum filter parameter and supplying the determined filter coefficients to a coefficient buffer provided for the sound localization filter.

11 Claims, 11 Drawing Sheets

METHOD OF DETERMINING A SOUND LOCALIZATION FILTER AND A SOUND LOCALIZATION CONTROL SYSTEM INCORPORATING THE FILTER

BACKGROUND OF THE INVENTION (1) Field of the Invention

The present invention relates to a method of determining a sound localization filter for approximation of a head related transfer function, and also relates to a sound localization control system incorporating the sound localization filter.

(2) Description of the Related Art

A technique of sound localization is known. In this method, a pair of microphones are provided at the positions of the two ears of a dummy head to record the original sound emitted from a sound source in a first space where the dummy head is arranged. The reproduced sound, obtained by reproducing the recorded sound, is supplied to a pair of headphone speakers provided at the positions of the two ears of a listener. By using this method, the listener can hear the reproduced sound as if the source of that sound was located, in a second space where the listener stays, at the same position as that of the actual sound source in the first space. This technique is called the sound localization.

Japanese Laid-Open Patent Application No.2-298200 discloses a technique of sound localization control which uses either an analog filter or a digital FIR (finite impulse response) filter. In the method of the above publication, the amplitude and the phase of binaural signals are controlled through signal processing so as to control the sound localization. The original sound emitted from the sound source is analyzed in the frequency domain, and the frequency-dependent amplitude difference and phase difference are applied through signal processing to the binaural signals of right and left channels which are supplied to the headphone speakers of the listener. By using the method of the above publication, the localized position of a simulated sound source within the second space relative to the position of the listener can be shifted to a desired position through the signal processing. In other words, the sound localization can be controlled by using the method of the above publication.

In order to realize the sound localization control, a sound localization filter must be adapted for approximation of a head related transfer function. FIG. 1A and FIG. 1B are diagrams for explaining a head related transfer function used for the sound localization control.

FIG. 1A shows a binaural system having a dummy head provided in a first space. In the system of FIG. 1A, a pair of microphones of the R (right) and L (left) channels are provided at the positions of the two ears of the dummy head to record the original sound emitted from a sound source in the first space where the dummy head is arranged. The reproduced sound, obtained by reproducing the recorded sound, is supplied to a pair of headphone speakers of the R and L channels provided at the positions of the two ears of a listener in a second space.

FIG. 1B shows a binaural system including a pair of sound localization (S/L) filters 101 and 102. The S/L filters 101 and 102 are provided between the microphones of the first space and the speakers of the second space for approximation of right-channel and left-channel head related transfer functions HRTF-R and HRTF-L. The system of FIG. 1B simulates the functions of the system of FIG. 1A by using the S/L filters 101 and 102.

In the system of FIG. 1B, the original monaural signals originated by the actual sound source in the first space are processed through the S/L filters 101 and 102 so as to shift the localized position of the simulated sound source within the second space relative to the position of the listener, to a desired position. In order to realize the sound localization control, measurements of the frequency characteristics of the head related transfer functions (the HRTF-R and HRTF-L) for each of a set of predetermined direction angles about the front position of the listener are needed. In the system of FIG. 1B, a plurality of sets of filter coefficients of the S/L filters 101 and 102 which represent the measured characteristics for all the predetermined direction angles are retained in a memory, and one of the sets of filter coefficients is selected according to the desired direction angle for the localized position, so as to apply the selected coefficients to the S/L filters 101 and 102.

"A Study on Clustering Method of Sound Localization Transfer Function" of the Institute of Electronics, Information And Communication Engineers (IEICE), EA9301 (1993.4), by S. Shimada and others, teaches a method of determining the sound localization transfer function by measurement of the impulse response of a digital filter to white noise generated in a given environment. FIG. 2 shows measurements of frequency characteristics of a head related transfer function with respect to a set of predetermined direction angles about the front position of a listener. In FIG. 2, the curve of 0° indicates the measured frequency characteristics for the front position of the listener, and the curves of 0° through 120° indicate the measured frequency characteristics for the set of predetermined direction angles 0° through 120°.

A sound localization (S/L) filter is realized by storing a plurality of sets of filter coefficients of a digital filter, which represent the measured filter characteristics, such as those of FIG. 2, for all the predetermined direction angles in a memory of a sound localization control system. One of the sets of filter coefficients stored in the memory is selected according to the desired direction angle for the localized position, so as to apply the selected coefficients to the digital filter. Hence, the sound localization control is possible by using the sound localization control system having the digital filter.

However, in a conventional sound localization control system having a digital filter, the sets of filter coefficients stored in the memory of the system are fixed to the measurements of the frequency characteristics of the digital filter in the given environment. It is impossible for the conventional sound localization control system to freely change the stored filter coefficients so as to suit the filter characteristics to various environments or the individual listeners.

Japanese Laid-Open Patent Application No. 5-252598 discloses a sound localization control system using a digital FIR (finite impulse response) filter. In the system of the above publication, a set of vectors of filter coefficients of the digital filter which represent typical filter characteristics, including the impulse responses of spatial transfer functions and the transfer functions of headphones, are obtained by using a clustering method of vector quantization, and such vectors of filter coefficients are stored in a database. However, the filter coefficients depend on the environments and the listeners used for the measurement, and it is difficult to change the stored filter coefficients so as to suit the filter characteristics to various environments or the individual listeners.

Further, the sound localization control system of the above-mentioned publication requires a large size of the hardware including the FIR filter and the database, and requires a computational complexity of signal processing. On the other hand, a digital IIR (infinite impulse response) filter can have a small size of the hardware with the coefficient memory, and makes it possible to easily change the stored filter coefficients so as to suit the filter characteristics to various environments or the individual listeners. However, a technique which designs a digital IIR filter for approximation of a transfer function with complex frequency characteristics, such as those of FIG. 2, is not yet established. In addition, it is desirable that the digital IIR filter is efficient in achieving the sound localization control. Generally, it is difficult to achieve complex frequency characteristics of a head related transfer function with a digital IIR filter, and a digital IIR filter is likely to become unstable due to limit cycle oscillation.

It has been reported that, when designing a digital IIR filter for approximation of a transfer function with complex frequency characteristics, such as those shown in FIG. 2, any simple frequency characteristics can be approximated by using a biquad digital filter (or a variable attenuation equalizer). One approach to designing a digital IIR filter for approximation of the head related transfer function is to perform the frequency transformation in the analog domain and then to convert the analog filter into a corresponding digital filter by a mapping of the s-plane into the z-plane. On the other hand, as disclosed in "IIR Filter Design" of the Interface, pp. 206–213, (1996.11) by H. Ochi, another approach is to directly designing an IIR filter in the frequency domain, which uses the sampling of frequency characteristics. However, this method requires the design of a high-order IIR filter and the order of the designed filter is not always constant.

SUMMARY OF THE INVENTION

An object of the present invention is to provide a novel and useful method of determining a sound localization filter for approximation of a head related transfer function in which the above-described problems are eliminated.

Another object of the present invention is to provide a sound localization filter determining method which determines a digital IIR filter for approximation of a head related transfer function, the digital IIR filter achieving smooth shifting of a localized position of a simulated sound source to another and achieving a small size of the hardware.

Still another object of the present invention is to provide a sound localization control system, incorporating sound localization filters for approximation of head related transfer functions of right and left channels, which achieves smooth shifting of a localized position of a simulated sound source to another by execution of a cross-fade function, and requires only a single IIR filter for one of the right and left channels.

The above-mentioned objects of the present invention are achieved by a sound localization filter determining method which includes the steps of: storing a plurality of sets of initial parameters with respect to a plurality of predetermined direction angles about a front position of a listener into a memory; reading one of the sets of initial parameters from the memory in accordance with a localization shift signal; calculating an optimum filter parameter based on the read initial parameters, the optimum filter parameter needed to approximate desired frequency characteristics of the head related transfer function; determining filter coefficients of the sound localization filter based on the optimum filter parameter; and supplying the determined filter coefficients to a coefficient buffer provided for the sound localization filter.

The above-mentioned objects of the present invention are achieved by a sound localization control system which shifts a localized position of a simulated sound source relative to a front position of a listener into a desired position in response to a localization shift signal and has a cross-fade function, the system including: a sound localization filter which inputs a sound signal and generates a localized sound signal based on filter coefficients and on the input sound signal, the filter having an input selector and an output selector; an input buffer which temporarily stores the input sound signal; a coefficient buffer which stores the filter coefficients of the filter; a first output buffer which temporarily stores the localized sound signal output by the filter when the filter is connected to the first output buffer via the output selector; a second output buffer which temporarily stores the localized sound signal output by the filter when the filter is connected to the second output buffer via the output selector; a fader, connected to the first and second output buffers, which provides the cross-fade function of the localized sound signals output from the first and second output buffers; and a control unit which replaces the filter coefficients stored in the coefficient buffer, with new filter coefficients by transmitting the new filter coefficients to the coefficient buffer when a localization shift signal is received, the control unit controlling the input and output selectors of the filter so as to connect the input buffer and the filter and connect the filter and one of the first and second output buffers, wherein the filter generates a new localized sound signal based on the sound signal stored in the input buffer and on the new filter coefficients stored in the coefficient buffer, and supplies the new localized sound signal to said one of the first and second output buffers via the output selector, the first and second output buffers outputting the localized sound signal and the new localized sound signal to the fader.

According to the sound localization filter determining method of the present invention, it is possible to achieve smooth shifting of the localized position of the simulated sound source to another with only a single IIR filter provided for one of the right and left channels. A sound localization control system incorporating the sound localization filter determined by the method of the present invention requires only a small size of the hardware. Further, the sound localization filter determined by the method of the present invention is effective in changing the stored filter coefficients in an arbitrary manner so as to adapt the filter characteristics to various environments or the individual listeners.

According to the sound localization control system of the present invention, it is possible to achieve smooth shifting of the localized position of the simulated sound source to another by execution of the cross-fade function with the right-channel and left-channel sound localization filters and the output buffers, and the sound localization control system of the present invention requires only a single IIR filter for one of the right and left channels. Further, the sound localization control system of the present invention is effective in achieving the execution of the cross-fade function with a small size of the hardware.

BRIEF DESCRIPTION OF THE DRAWINGS

Other objects, features and advantages of the present invention will become more apparent from the following detailed description when read in conjunction with the accompanying drawings in which.

DETAILED DESCRIPTION OF THE PREFERRED EMBODIMENTS

Before explaining the preferred embodiments of the present invention, a description will now be given of a conceivable sound localization control system with reference to the accompanying drawings, in order to facilitate understanding of the principles of the present invention.

Figure 3:
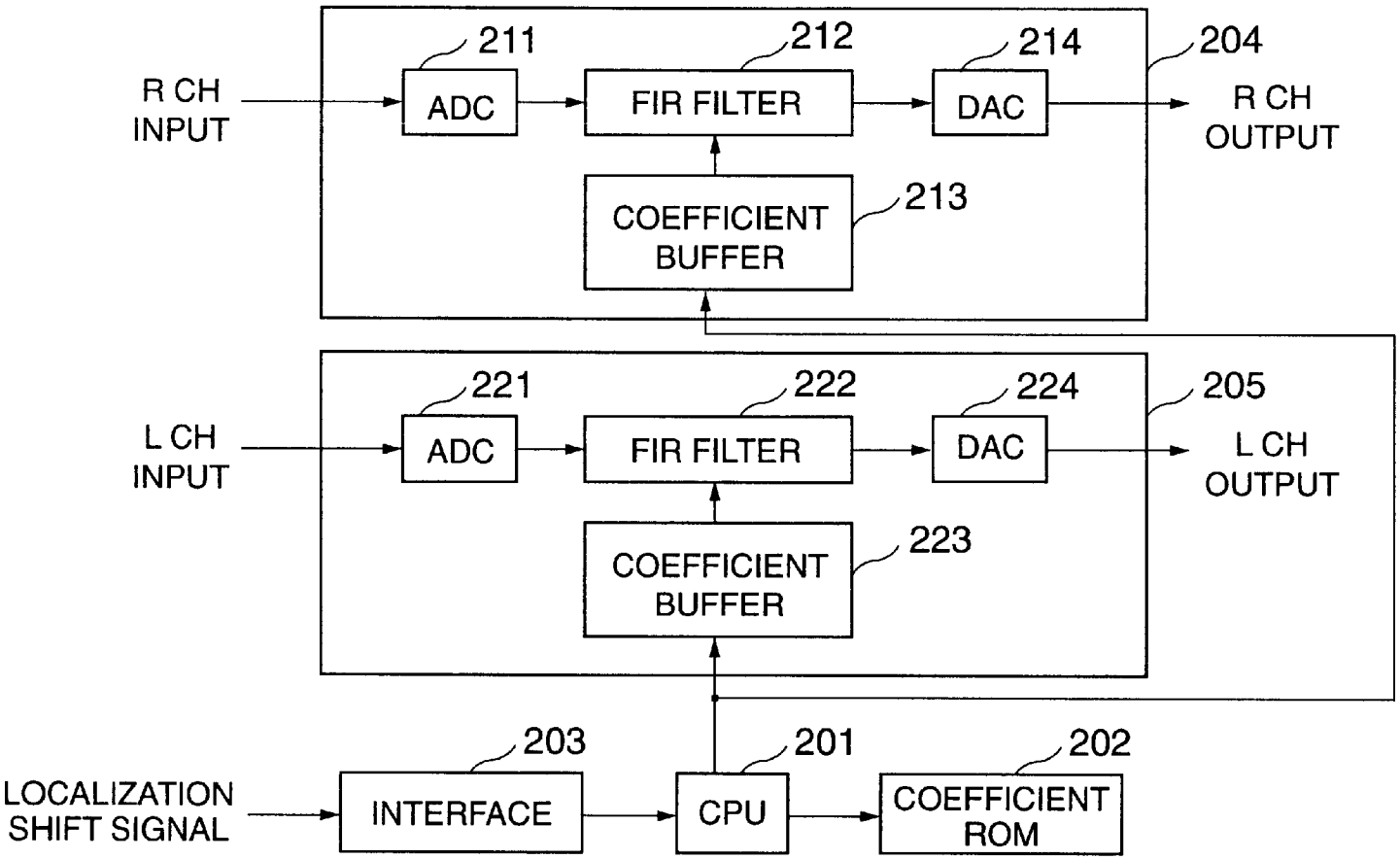
FIG. 3 is a block diagram of a conceivable sound localization control system.

FIG. 3 shows a conceivable sound localization control system.

As shown in FIG. 3, the sound localization control system generally has a CPU 201, a coefficient ROM 202, an interface unit 203, a right-channel filter module 204, and a left-channel filter module 205.

In the system of FIG. 3, the CPU 201 controls the entire system. The right-channel filter module 204 includes an analog-to-digital converter (ADC) 211, a sound localization (S/L) filter 212, a coefficient buffer 213, and a digital-to-analog converter (DAC) 214. The ADC 211 inputs an analog right-channel sound signal (R CH INPUT), and converts the input signal into a digital signal. The S/L filter 212 is comprised of a digital FIR filter. The coefficient buffer 213 stores filter coefficients transmitted by the CPU 201. The S/L filter 212 outputs a digital right-channel localized sound signal based on the digital signal at the output of the ADC 211 and on the filter coefficients at the output of the coefficient buffer 213. The DAC 214 converts the sound signal at the output of the S/L filter 212 into an analog right-channel localized sound signal (R CH OUTPUT).

Further, in the system of FIG. 3, the left-channel filter module 205 includes an analog-to-digital converter (ADC) 221, a sound localization (S/L) filter 222, a coefficient buffer 223, and a digital-to-analog converter (DAC) 224. The ADC 221 inputs an analog left-channel sound signal (L CH INPUT), and converts the input signal into a digital signal. The S/L filter 222 is comprised of a digital FIR filter. The coefficient buffer 223 stores filter coefficients transmitted by the CPU 201. The S/L filter 222 outputs a digital left-channel localized sound signal based on the digital signal at the output of the ADC 221 and on the filter coefficients at the output of the coefficient buffer 223. The DAC 224 converts the sound signal at the output of the S/L filter 222 into an analog left-channel localized sound signal (L CH OUTPUT).

In the system of FIG. 3, the filter coefficients for each of the FIR filters 212 and 222 are stored in the coefficient ROM 202. When a localization shift signal is supplied through the interface unit 203 to the CPU 201, the CPU 201 reads the filter coefficients (relevant to the localization shift signal) from the coefficient ROM 202 and transmits the filter coefficients to the coefficient buffers 213 and 223 for the FIR filters 212 and 222. By using the calculation of the read filter coefficients on the FIR filters 212 and 222, the localized position of a simulated sound source relative to the position of the listener can be shifted to a desired position according to the localization shift signal.

However, in the sound localization control system of FIG. 3, the filter coefficients, stored in the coefficient ROM 202, are measurements of the frequency characteristics of the head related transfer functions, for each of a set of predetermined direction angles about the front position of the listener, which are produced in a given standard environment. It is impossible to change the filter coefficients, stored in the coefficient ROM 202, so as to suit the filter characteristics to various environments or the individual listeners. Further, the sound localization control system of FIG. 3 requires a large size of the hardware including the FIR filters 212 and 222 and the ROM 202.

As disclosed in Japanese Laid-Open Patent Application No. 6-245300, a sound localization control system having a cross-fade function is known. When shifting one localized position of the simulated sound source into another is requested by a localization shift signal, the filter coefficients retained in the coefficient buffers must be changed by new ones in the sound localization control system. If the sound localization filter in this system is comprised of a digital FIR filter having a number of delay lines, the change of the filter coefficients needs a certain processing time until the filter characteristics based on the new filter coefficients become stable. Because of this, a switching noise or the like often occurs when the localized position is shifted to the new one. In order to avoid such a problem, the sound localization control system of the above publication is adapted to have the cross-fade function.

Figure 4:
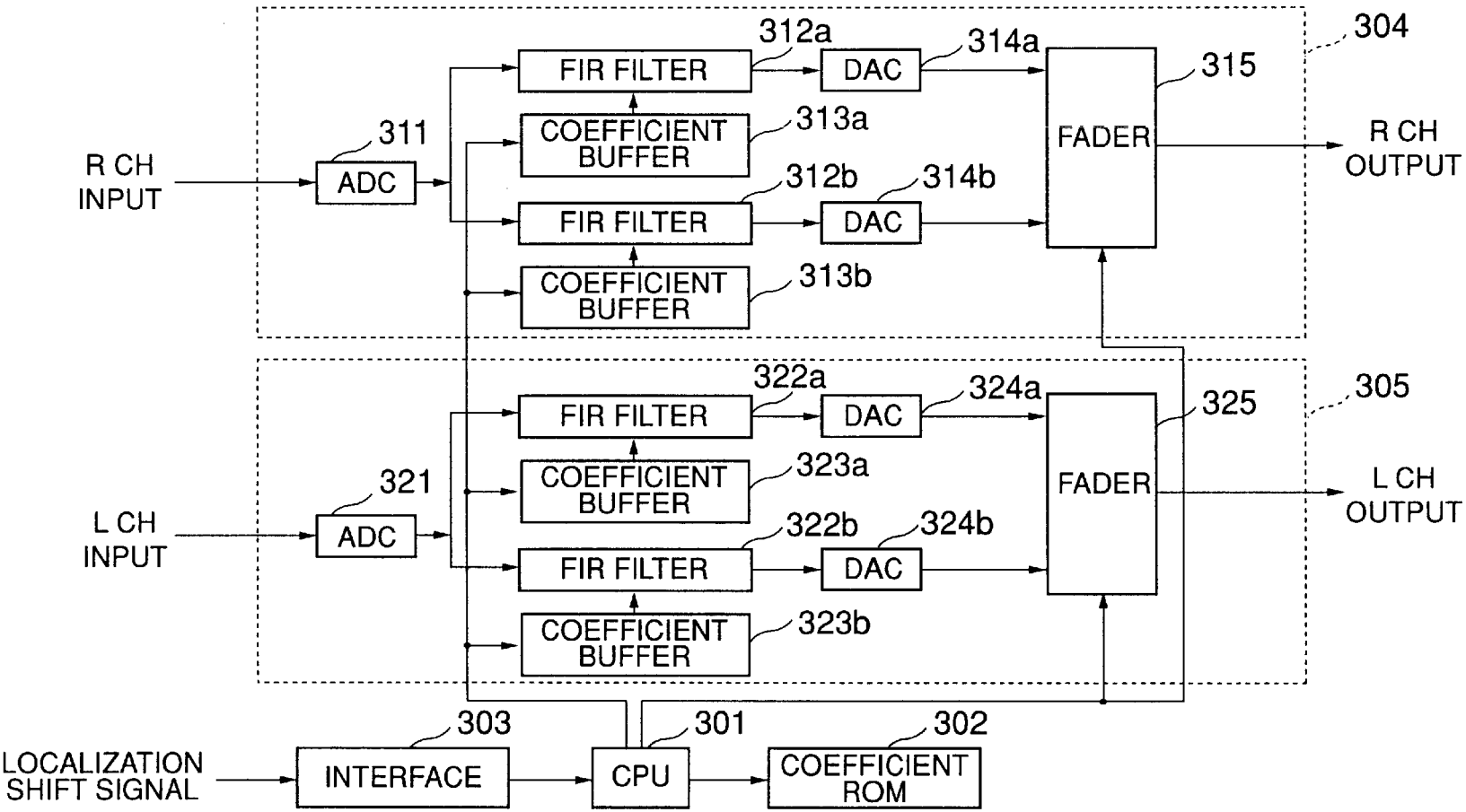
FIG. 4 is a block diagram of a conceivable sound localization control system having a cross-fade function.
Figure 5:
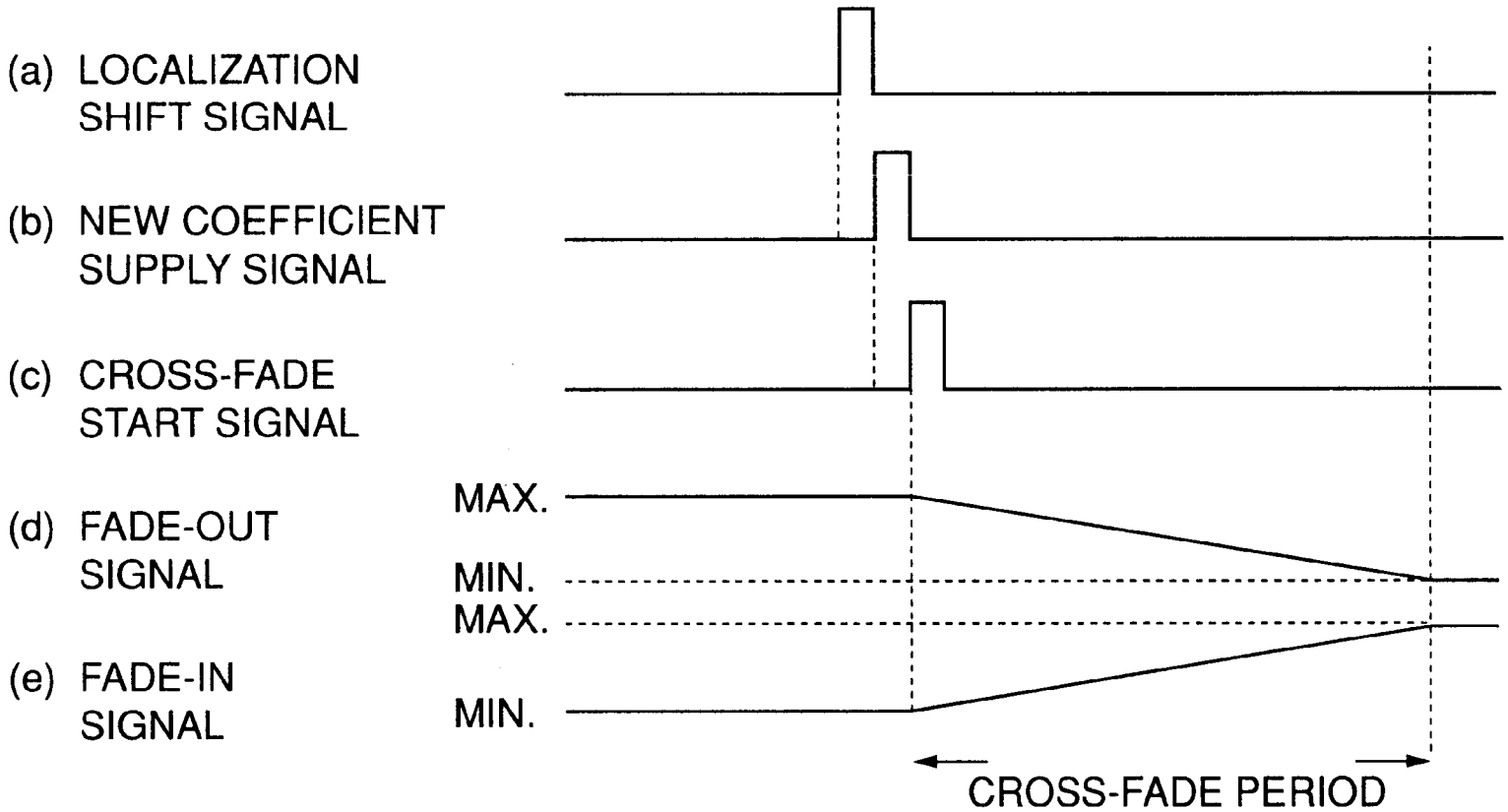
FIG. 5 is a time chart for explaining the cross-fade function of the sound localization control system of FIG. 4.

FIG. 4 shows a conceivable sound localization control system having a cross-fade function when the above-mentioned publication is taken into consideration. FIG. 5 is a time chart for explaining the cross-fade function of the sound localization control system of FIG. 4.

As shown in FIG. 4, the above-mentioned sound localization control system generally has a CPU 301, a coefficient ROM 302, an interface unit 303, a right-channel filter module 304, and a left-channel filter module 305.

In the system of FIG. 4, the CPU 301 controls the entire system. The coefficient ROM 302 stores a plurality of filter coefficients for each of sound localization filters of this system with respect to a plurality of predetermined direction angles about the front position of the listener. A localization shift signal is supplied from an external system through the interface unit 303 into the CPU 301.

The right-channel filter module 304 includes an analog-to-digital converter (ADC) 311, a digital FIR filter 312*a*, a digital FIR filter 312*b*, a coefficient buffer 313*a*, a coefficient buffer 313*b*, a digital-to-analog converter (DAC) 314*a*, a digital-to-analog converter (DAC) 314*b*, and a fader 315.

The ADC 311 inputs an analog right-channel sound signal (R CH INPUT), and converts the input signal into a digital signal. The ADC 311 supplies the digital signal to each of the inputs of the FIR filter 312*a* and the FIR filter 312*b*. The coefficient buffer 313*a* stores filter coefficients of the FIR filter 312*a* which are read from the coefficient ROM 302 and transmitted by the CPU 301. The coefficient buffer 313*b* stores filter coefficients of the FIR filter 312*b* which are read from the coefficient ROM 302 and transmitted by the CPU 301.

Each of the FIR filters 312*a* and 312*b* outputs a digital right-channel localized sound signal based on the digital signal at the output of the ADC 311 and based on the filter coefficients at the related one of the outputs of the coefficient buffers 313*a* and 313*b*. Each of the DACs 314*a* and 314*b* converts the right-channel localized sound signal, output from the related one of the FIR filters 312*a* and 312*b,* into an analog right-channel localized sound signal. Both the analog right-channel localized sound signals are supplied from the DACs 314*a* and 314*b* to the fader 315. The fader 315 is comprised of two variable attenuators and an adder, and constitutes a part of the cross-fade function.

Further, in the system of FIG. 4, the left-channel filter module 305 includes an analog-to-digital converter (ADC) 322, a digital FIR filter 322*a,* a digital FIR filter 322*b,* a coefficient buffer 323*a,* a coefficient buffer 323*b,* a digital-to-analog converter (DAC) 324*a,* a digital-to-analog converter (DAC) 324*b,* and a fader 325. The ADC 321 inputs an analog left-channel sound signal (L CH INPUT), and converts the input signal into a digital signal. The ADC 321 supplies the digital signal to each of the inputs of the FIR filter 322*a* and the FIR filter 322*b*. The coefficient buffer 323*a* stores filter coefficients of the FIR filter 322*a* which are read from the coefficient ROM 302 and transmitted by the CPU 301. The coefficient buffer 323*b* stores filter coefficients of the FIR filter 322*b* which are read from the coefficient ROM 302 and transmitted by the CPU 301.

Each of the FIR filters 322*a* and 322*b* outputs a digital left-channel localized sound signal based on the digital signal at the output of the ADC 321 and based on the filter coefficients at the related one of the outputs of the coefficient buffers 323*a* and 323*b*. Each of the DACs 324*a* and 324*b* converts the left-channel localized sound signal, output from the related one of the FIR filters 322*a* and 322*b,* into an analog left-channel localized sound signal. Both the analog left-channel localized sound signals are supplied from the DACs 324*a* and 324*b* to the fader 325. The fader 325 is comprised of two variable attenuators and an adder, and constitutes a part of the cross-fade function.

In the above-mentioned system of FIG. 4, the CPU 301 reads filter coefficients of the right-channel FIR filters 312*a* and 312*b* from the coefficient ROM 302 in accordance with the localization shift signal, and transmits the filter coefficients to one of the coefficient buffers 313*a* and 313*b* alternately. At the same time, the CPU 301 reads filter coefficients of the left-channel FIR filters 322*a* and 322*b* from the coefficient ROM 302 in accordance with the localization shift signal, and transmits the filter coefficients to one of the coefficient buffers 323*a* and 323*b* alternately. If the FIR filter 312*a* has already output the localized sound signal based on the previous filter coefficients in the coefficient buffer 313*a,* the FIR filter 312*b* outputs the localized sound signal based on the new filter coefficients in the coefficient buffer 313*b*. The fader 315 serves to make the previous-coefficient-based localization sound signals to fade out within a cross-fade period and to simultaneously make the new-coefficient-based localization sound signals to fade in within the cross-fade period. Similarly, if the FIR filter 322*a* has already output the localized sound signal based on the previous filter coefficients in the coefficient buffer 323*a,* the FIR filter 322*b* outputs the localized sound signal based on the new filter coefficients in the coefficient buffer 323*b*. The fader 325 serves to make the previous-coefficient-based localization sound signals to fade out within the cross-fade period and to simultaneously make the new-coefficient-based localization sound signals to fade in within the cross-fade period.

Suppose that shifting one localized position (for example, 60°) of the simulated sound source relative to the front position of the listener into another (for example, 90°) is now requested by a localization shift signal. At this instant, the FIR filters 312*a* and 322*a* are operating on the previous filter coefficients (for the 60° position) in the coefficient buffers 313*a* and 323*a* while the FIR filters 312*b* and 322*b* are not effectively operating.

As indicated by (a) in FIG. 5, the localization shift signal is supplied through the interface unit 53 to the CPU 301. As indicated by (b) in FIG. 5, a new coefficient supply signal is issued by the CPU 301, and new filter coefficients (for the 90° position) are instantly read from the coefficient ROM 302 and transmitted to the coefficient buffers 313*b* and 323*b*. As indicated by (c) in FIG. 5, at a timing synchronous to the falling edge of the new coefficient supply signal, a cross-fade start signal is issued by the CPU 301.

As indicated by (d) in FIG. 5, the fader 315 is controlled to make the previous-coefficient-based localization sound signals, output by the FIR filter 312*a,* to fade out within a cross-fade period (for example, several ten milliseconds) and to simultaneously make the new-coefficient-based localization sound signals, output by the FIR filter 312*b,* to fade in within the cross-fade period. At the same time, the fader 325 is controlled to make the previous-coefficient-based localization sound signals, output by the FIR filter 322*a,* to fade out within the cross-fade period and to simultaneously make the new-coefficient-based localization sound signals, output by the FIR filter 322*b,* to fade in within the cross-fade period.

In the system of FIG. 4, when the localization shift signal is supplied, the faders 315 and 325 serve to make the previous-coefficient-based localization sound signals to fade out within a cross-fade period and to simultaneously make the new-coefficient-based localization sound signals to fade in within the cross-fade period as indicated by (d) and (e) in FIG. 5. Hence, the above-described system achieves smooth shifting of the localized position to another by execution of the cross-fade function.

However, the above-described system requires a large size of the hardware including the FIR filters 312*a,* 312*b,* 322*a* and 322*b* and the coefficient buffers 313*a,* 313*b,* 323*a* and 323*b*. This configuration of the sound localization control system considerably raises the cost of manufacture.

With the above points of the conceivable sound localization control systems of FIG. 3 and FIG. 4 being kept in mind, a description will now be given of the preferred embodiments of the present invention with reference to the accompanying drawings.

In order to obtain a digital IIR filter for approximation of a head related transfer function having complex frequency characteristics, the sound localization filter determining method of the present invention begins with an analog filter and then uses the mapping to transform the s-plane into the z-plane.

When shifting a localized position of a simulated sound source into an intermediate position between predetermined direction angles about the front position of the listener is requested by the localization shift signal, the sound localization control system of the present invention, incorporating such a sound localization filter for approximation of the head related transfer function, achieves smooth shifting of the localized position into the intermediate position by execution of a parameter interpolation calculation, which will be described later.

Further, when shifting a localized position of a simulated sound source into another position, the sound localization control system of the present invention, incorporating such sound localization filters for approximation of the head related transfer functions of the right and left channels, achieves smooth shifting of the localized position to another by execution of a cross-fade function, which will be described later.

Figure 6:
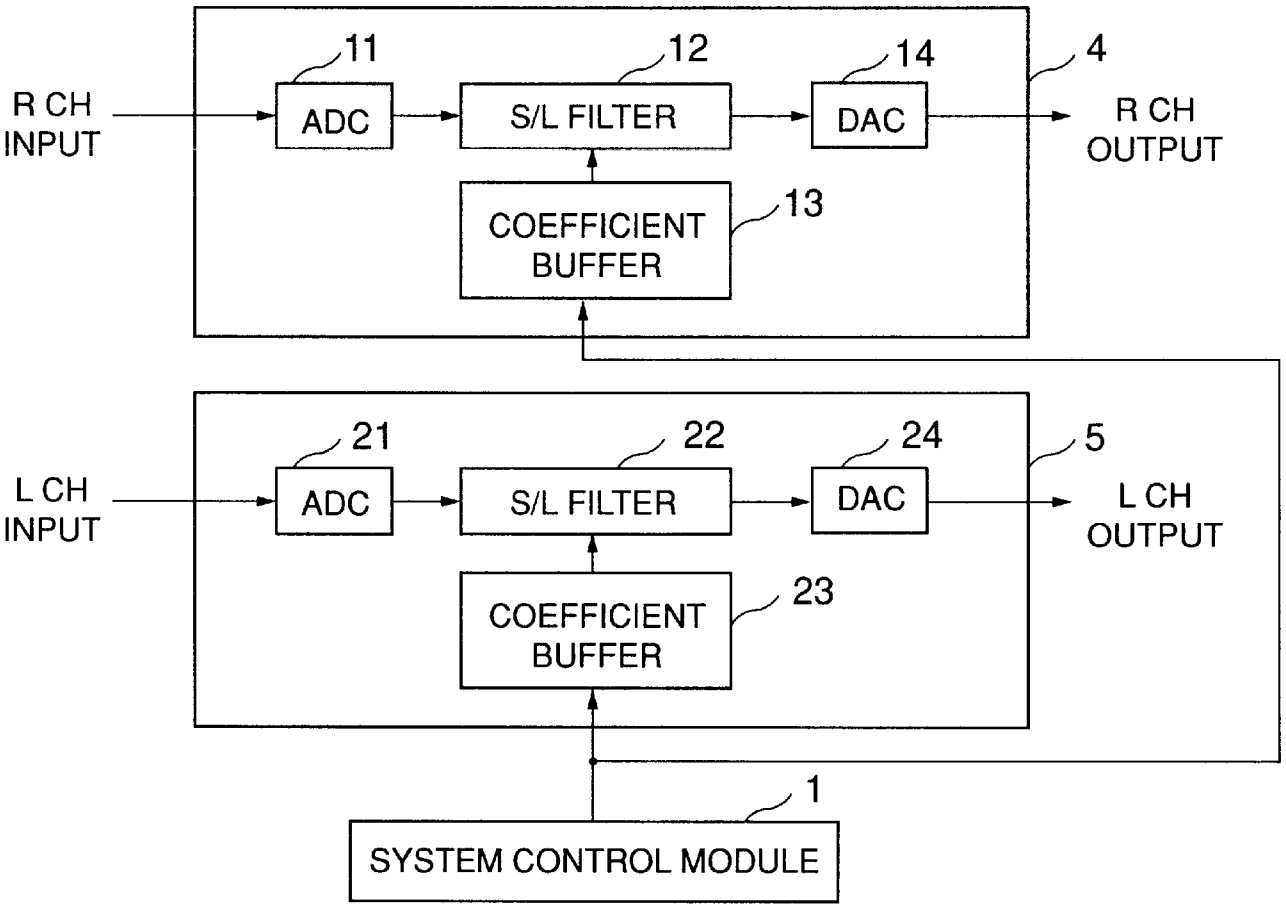
FIG. 6 is a block diagram of a sound localization control system incorporating the principles of the present invention.

FIG. 6 shows a sound localization control system incorporating the principles of the present invention.

As shown in FIG. 6, the sound localization control system of the present invention generally has a system control module 1, a right-channel filter module 4, and a left-channel filter module 5.

In the sound localization control system of FIG. 6, the system control module 1 controls the entire system. The right-channel filter module 4 includes an analog-to-digital converter (ADC) 11, a sound localization (S/L) filter 12, a coefficient buffer 13, and a digital-to-analog converter (DAC) 14. The ADC 11 inputs an analog right-channel sound signal (R CH INPUT), and converts the input signal into a digital signal. The S/L filter 12 is comprised of a digital IIR filter determined by the method of the present invention. The coefficient buffer 13 stores filter coefficients transmitted by the system control module 1. The S/L filter 12 outputs a digital right-channel localized sound signal based on the digital signal at the output of the ADC 11 and on the filter coefficients at the output of the coefficient buffer 13. The DAC 14 converts the sound signal at the output of the S/L filter 12 into an analog right-channel localized sound signal (R CH OUTPUT).

Further, in the system of FIG. 6, the left-channel filter module 5 includes an analog-to-digital converter (ADC) 21, a sound localization (S/L) filter 22, a coefficient buffer 23, and a digital-to-analog converter (DAC) 24. The ADC 21 inputs an analog left-channel sound signal (L CH INPUT), and converts the input signal into a digital signal. The S/L filter 22 is comprised of a digital IIR filter determined by the method of the present invention. The coefficient buffer 23 stores filter coefficients transmitted by the system control module 1. The S/L filter 22 outputs a digital left-channel localized sound signal based on the digital signal at the output of the ADC 21 and on the filter coefficients at the output of the coefficient buffer 23. The DAC 24 converts the sound signal at the output of the S/L filter 22 into an analog left-channel localized sound signal (L CH OUTPUT).

A localization shift signal is supplied by an external system (for example, a computer game machine) to the system control module 1. The localization shift signal is also called the localization shift command. The localization shift signal from the external system requests the system control module 1 to shift a localized position of a simulated sound source within the second space relative to the front position of the listener, to a desired position. The localization shift signal indicates a specific value (for example, +120°) of the new direction angle to which the currently localized position of the simulated sound source is changed. The S/L filters 12 and 13 in the sound localization control system of FIG. 6 provide the right-channel and left-channel output signals at their outputs which suit the localization shift signal supplied to the input of the system control module 1. The analog right-channel and left-channel localized sound signals (R CH OUTPUT and L CH OUTPUT) produced by the DAC 14 and the DAC 24 are supplied to the headphone speakers provided at the positions of the two ears of the listener. The filter coefficients applied to the S/L filters 12 and 22 are changed instantly a new localization shift signal is supplied to the system control module 1, so as to suit the movement of a game object displayed on the computer game machine.

Figure 7:
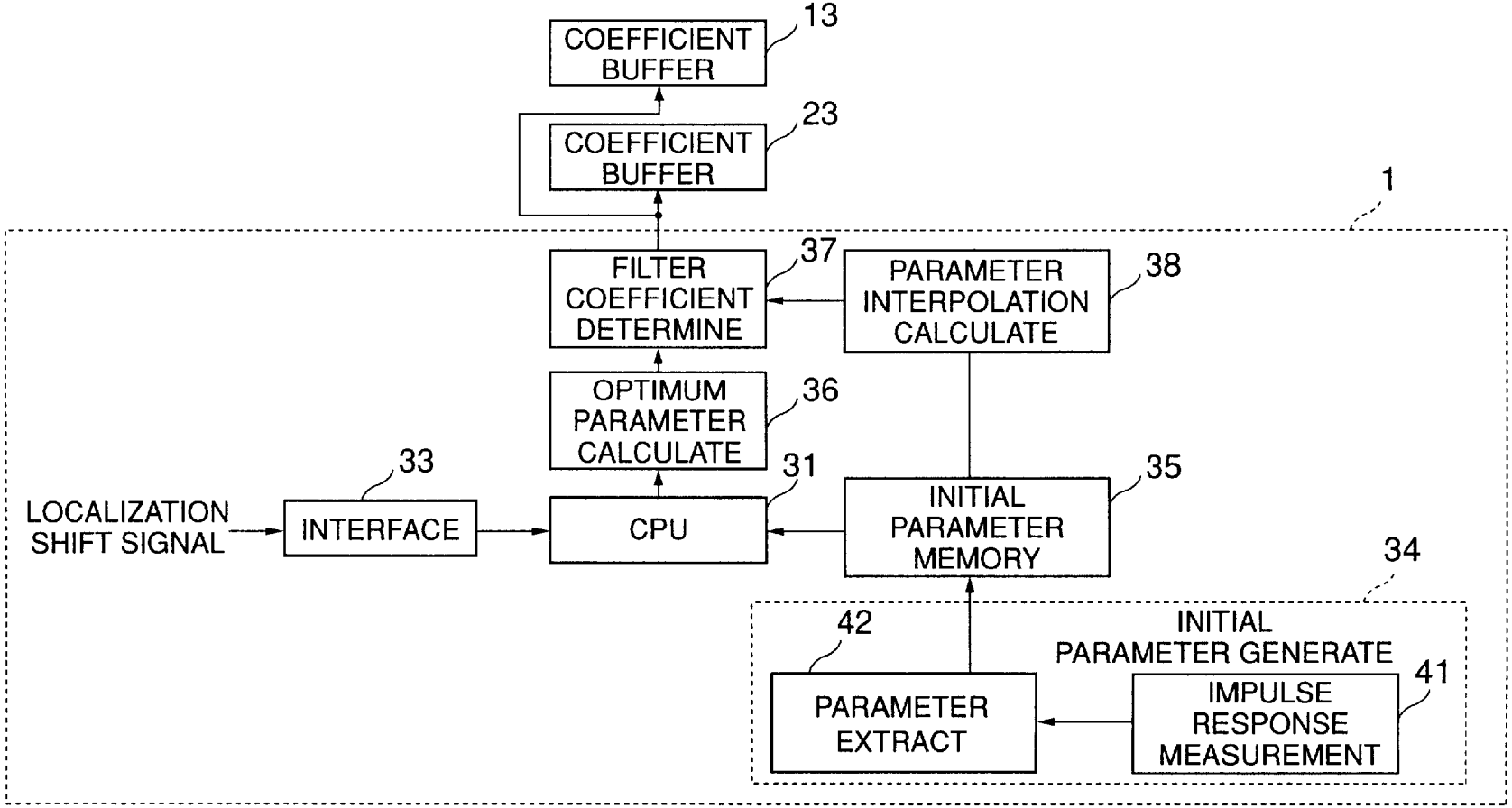
FIG. 7 is a block diagram of a system control module in the sound localization control system of FIG. 6.

FIG. 7 shows an embodiment of the system control module 1 in the sound localization control system of FIG. 6.

In the system control module 1 of FIG. 7, a central processing unit (CPU) 31, an interface unit 33, an initial parameter generating unit 34, an initial parameter memory 35, an optimum parameter calculating unit 36, a filter coefficient determining unit 37, and a parameter interpolation calculating unit 38 are provided.

In the system control module 1 of FIG. 7, a localization shift signal is supplied by an external system through the interface unit 33 into the CPU 31. The localization shift signal from the external system requests the CPU 31 to shift a localized position of a simulated sound source within the second space relative to the front position of the listener, to a desired position.

In the system control module 1 of FIG. 7, the initial parameter generating unit 34 generates initial parameters to be stored in the initial parameter memory 35. The initial parameter memory 35 stores a plurality of sets of initial parameters with respect to a plurality of predetermined direction angles about the front position of the listener. The CPU 31 reads one of the sets of initial parameters from the initial parameter memory 35 in accordance with the localization shift signal, and transmits the initial parameters to the optimum parameter calculating unit 36. The optimum parameter calculating unit 36 calculates an optimum filter parameter based on the initial parameters transmitted by the CPU 31. The filter coefficient determining unit 37 determines filter coefficients of each of the S/L filter 12 and the S/L filter 22 based on the optimum filter parameter supplied by the optimum parameter calculating unit 36. The CPU 31 controls the filter coefficient determining unit 37 such that the determined filter coefficients are supplied from the filter coefficient determining unit 37 to each of the coefficient buffer 13 and the coefficient buffer 23.

In the system control module 1 of FIG. 7, the parameter interpolation calculating unit 38 is provided. When shifting the localized position of the simulated sound source into an intermediate position between the predetermined direction angles about the front position of the listener is requested by the localization shift signal, the parameter interpolation calculating unit 38 calculates interpolated parameters based on the initial parameters (which are relevant to the localization shift command) read from the initial parameter memory 35. The filter coefficient determining unit 37 determines filter coefficients of each of the S/L filter 12 and the S/L filter 22 based on the interpolated parameters supplied by the parameter interpolation calculating unit 38. The CPU 31 controls the filter coefficient determining unit 37 such that the determined filter coefficients are supplied from the filter coefficient determining unit 37 to each of the coefficient buffer 13 and the coefficient buffer 23, so as to suit the localization shift command.

Figure 1A:
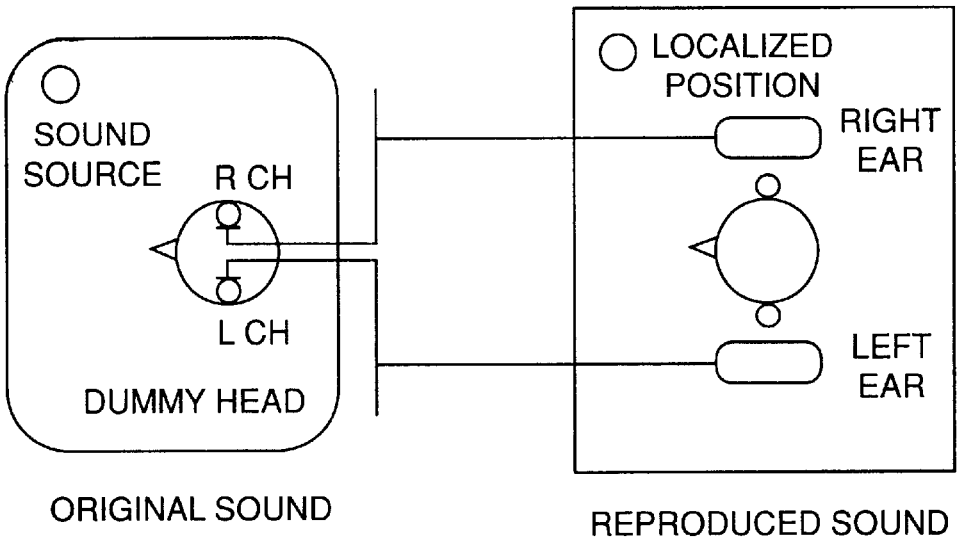
FIG. 1A and FIG. 1B are diagrams for explaining a head related transfer function used for sound localization control.
Figure 1B:
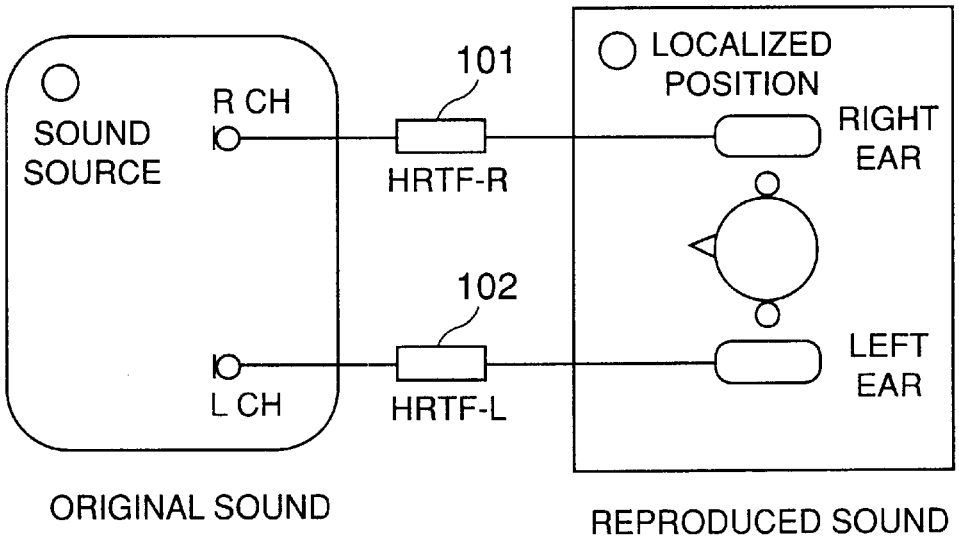
Figure 2:
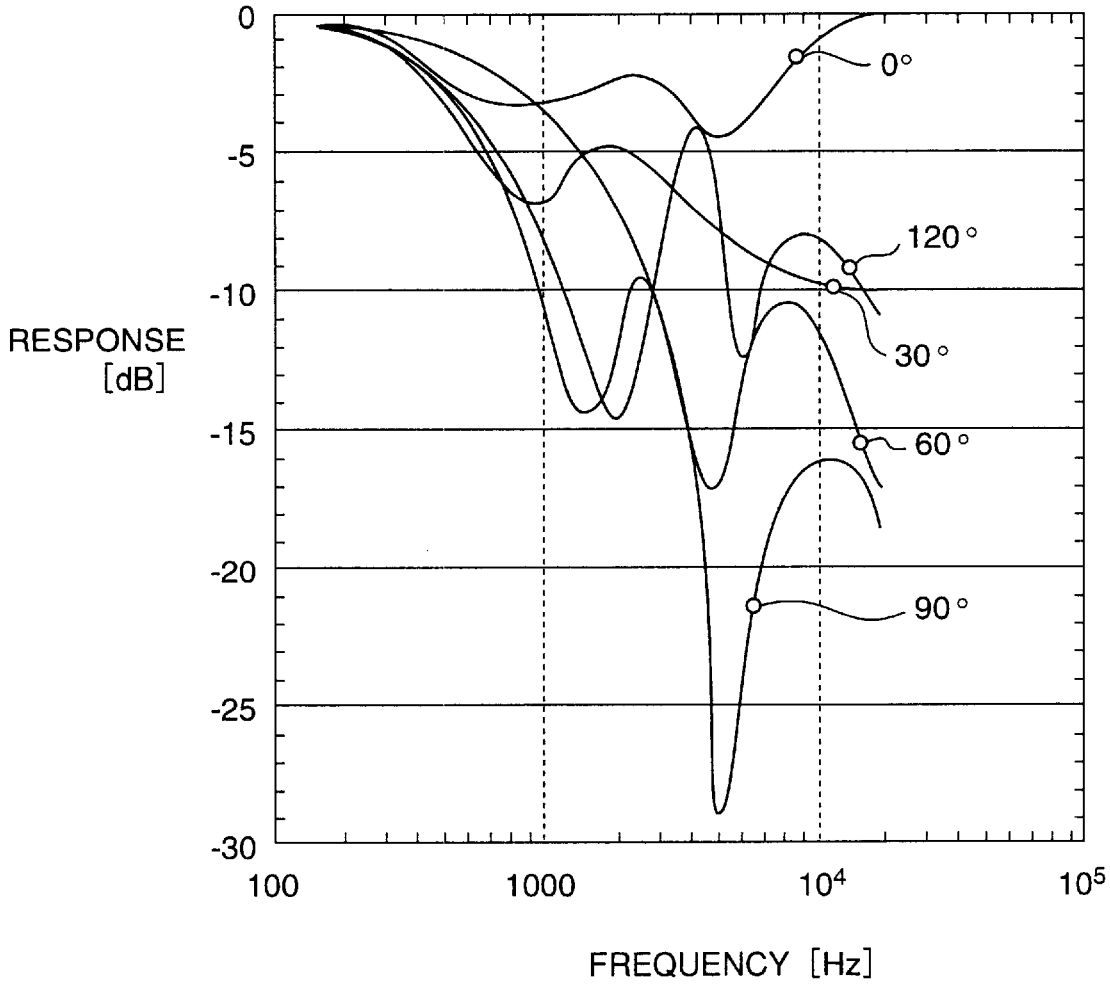
FIG. 2 is a diagram for explaining measurements of frequency characteristics of a head related transfer function.

As shown in FIG. 7, the initial parameter generating unit 34 includes an impulse response measurement unit 41 and a parameter extracting unit 42. The impulse response measurement unit 41 provides measurements of the frequency characteristics of the head related transfer functions (the HRTF-R and HRTF-L) for each of the predetermined direction angles about the front position of the listener, such as those shown in FIG. 2. The parameter extracting unit 42 extracts initial parameters from the measurements of the frequency characteristics supplied by the impulse response measurement unit 41. The parameter extracting unit 42 supplies the initial parameters to the initial parameter memory 35, so that the plurality of sets of initial parameters with respect to each of the predetermined direction angles about the front position of the listener are stored in the initial parameter memory 35.

In the present embodiment, the initial parameters, extracted by the parameter extracting unit 42, are a plurality of sets of filter parameters each including a center (cutoff) frequency fc, a quality factor Q and a filter gain L (related to each of the S/L filters 12 and 22) for one of predetermined direction angles 0° through 120° with 30-degree increments about the front position of the listener. Such initial parameters (fc, Q, L) are stored in the initial parameter memory 35.

As previously described, one of the sets of initial parameters (fc, Q, L) (which are relevant to the localization shift signal) is read from the initial parameter memory 35 by the CPU 31, and the CPU 31 transmits the initial parameters to the optimum parameter calculating unit 36. The optimum parameter calculating unit 36 calculates an optimum filter parameter based on the initial parameters transmitted by the CPU 31. The filter coefficient determining unit 37 determines filter coefficients of each of the S/L filter 12 and the S/L filter 22 based on the optimum filter parameter supplied by the optimum parameter calculating unit 36. The CPU 31 controls the filter coefficient determining unit 37 such that the determined filter coefficients are supplied from the filter coefficient determining unit 37 to each of the coefficient buffer 13 and the coefficient buffer 23. Hence, the S/L filters 12 and 13 in the sound localization control system provide the right-channel and left-channel output signals at their outputs which suit the localization shift signal at the input of the CPU 31.

Further, when shifting the localized position of the simulated sound source into an intermediate position between the predetermined direction angles (0° through 120° with 30-degree increments) about the front position of the listener is requested by the localization shift signal, the parameter interpolation calculating unit 38 calculates interpolated parameters based on the two adjacent initial parameters (which are relevant to the localization shift signal) read from the initial parameter memory 35. The filter coefficient determining unit 37 determines filter coefficients of each of the S/L filter 12 and the S/L filter 22 based on the interpolated parameters supplied by the parameter interpolation calculating unit 38. The CPU 31 controls the filter coefficient determining unit 37 such that the determined filter coefficients are supplied from the filter coefficient determining unit 37 to each of the coefficient buffer 13 and the coefficient buffer 23, so as to suit the localization shift command.

Next, a description will be given of the sound localization filter determining method of the present invention which is achieved by the system control module 1 of FIG. 7. Specifically, the sound localization filter determining method of the present invention is characterized by the optimum filter parameter calculation (performed by the element 36 of FIG. 7) and the filter coefficient determination (performed by the element 37 of FIG. 7) which are achieved by the elements of the system control module 1.

As disclosed in U.S. Pat. No. 4,188,504, the use of analog filters for processing binaural signals is known. Also, as disclosed in the above publication, it is possible to easily obtain an analog filter for approximation of a head related transfer function by using a signal processing circuit. In order to obtain a digital IIR filter for approximation of a head related transfer function having complex frequency characteristics, the sound localization filter determining method of the present invention begins with an analog filter and then uses the mapping to transform the s-plane into the z-plane. This mapping is commonly known as the s-z transformation.

Supposing that X(s) denotes the sound source, $H_L(s)$ indicates the transfer function between the sound source and the left ear $E_L(s)$ of the listener, and $H_R(s)$ indicates the transfer function between the sound source and the right ear $E_R(s)$ of the listener, the following equation can be derived.

$$\begin{bmatrix} E_L(s) \\ E_R(s) \end{bmatrix} = X(s)H_L(s)\begin{bmatrix} 1 \\ H_R(s)/H_L(s) \end{bmatrix} \tag{1}$$

In the above equation, the term $H_R(s)/H_L(s)$ indicates the ratio of the right-ear transfer function characteristics to the left-ear transfer function characteristics. The right-side terms of the above equation (1) (having the s-plane system function) are related to the head related transfer functions with complex frequency characteristics, such as those shown in FIG. 2. In the sound localization filter determining method of the present invention, approximation of such transfer functions is achieved by using a digital IIR filter. Generally, a digital IIR filter has a simple structure and can be constructed with a small size of the coefficient memory, and the filter characteristics of the IIR filter can be easily changed.

The sound localization filter determining method of the present invention is adapted to determining a digital IIR filter for approximation of the head related transfer function by cascading of a two-zero, two-pole biquad transfer function into an analog filter having the desired frequency characteristics, and then using the mapping to transform the s-plane into the z-plane. If specific filter parameters (Fc, Q, L) are given, then the filter characteristics are determined. The filter characteristics can be changed by suitably varying the filter parameters. A biquad transfer function $H(Z^{-1})$ in the z-plane is represented by the following equation, $$H(Z^{-1}) = \prod_{i=1}^{n} a_{i0}(1 + a_{i1}Z^{-1} + a_{i2}Z^{-2})/(1 + b_{i1}Z^{-1} + b_{i2}Z^{-2}) \tag{2}$$

where $a_{i0}$ denotes the scaling factor, $a_{i1}$, $a_{i2}$, $b_{i1}$ and $b_{i2}$ indicate the filter coefficients, and n indicates the filter order. A technique for designing a digital IIR filter for approximation of the head related transfer function based on the above equation (2) is not yet established, and one must perform a heuristic designing process (or a trial-and-error method) in order to design the digital IIR filter.

In order to approximate the desired frequency characteristics of the head related transfer function, the filter parameters Fc, Q and L are suitably varied. One approach is to optimize the filter parameters so as to approximate the desired frequency characteristics such that the differences between the desired frequency characteristics and the design filter characteristics at appropriate frequency points are minimized. However, this method requires a large amount of calculation of the filter characteristics at many frequency points, and this is not efficient.

In order to efficiently obtain the approximation of the desired frequency characteristics, the sound localization filter determining method incorporating the principles of the present invention selects three sample frequency points which include a center frequency point fc, a preceding inflection point and a following inflection point of a design transfer function represented by the above equation (2). In the sound localization filter determining method of the present invention, a filter parameter (one of the initial parameters) is changed so as to approximate the desired frequency characteristics such that the difference errors between the desired frequency characteristics and the design filter characteristics at the sample frequency points are minimized. The filter parameter is then optimized. The filter coefficients of the sound localization filter are determined based on the optimum filter parameter that is optimum to approximate the desired frequency characteristics.

As disclosed in "Design And Test of IIR Filter with Complex Frequency Characteristics" of the Transactions of the Japanese Acoustics Association, 3-3-2, pp. 571–572 (1997.3), by A. Miyauchi and others, if a sample frequency point in the vicinity of a point of inflection of the transfer function is selected, the sample frequency point is appropriate for an interpolation point at which the two components of the transfer function are continuously cascaded to each other.

In the sound localization filter determining method incorporating the principles of the present invention, the center (cutoff) frequency fc and its neighboring frequencies at the points of inflection of a biquad transfer function represented by the above equation (2) are selected as being the sample frequency points.

Figure 8:
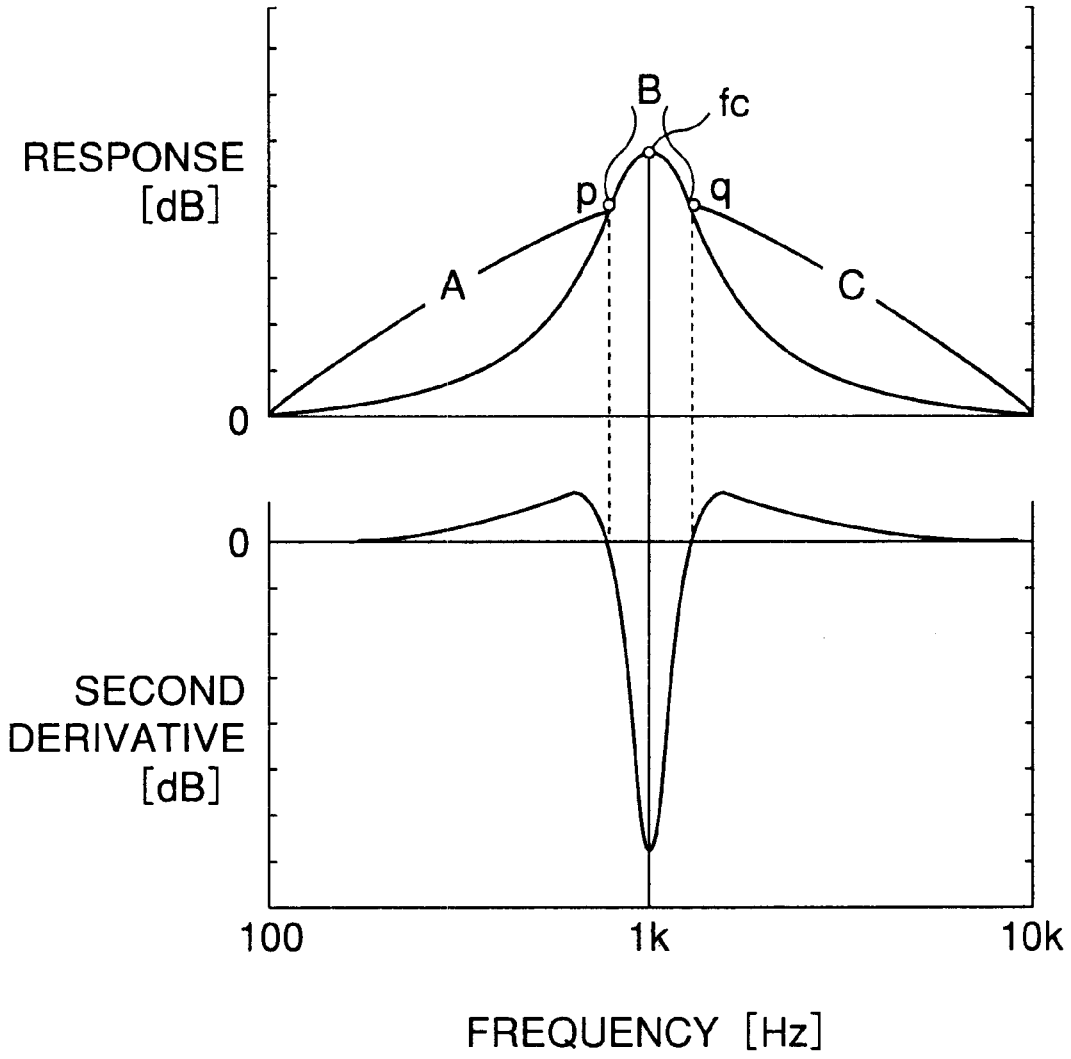
FIG. 8 is a diagram for explaining determination of sample frequency points of a transfer function which is performed for calculation of the optimum filter parameter needed to approximate the desired frequency characteristics.

FIG. 8 is a diagram for explaining determination of sample frequency points of a transfer function which is performed for calculation of the optimum filter parameter needed to approximate the desired frequency characteristics.

As shown in FIG. 8, when calculating an optimum filter parameter needed to approximate the desired frequency characteristics, the second derivative of a design filter function is first obtained. Two points "p" and "q" of inflection on the design filter function where the second derivative function is equal to zero are then determined. The design filter function is shown in the upper half of FIG. 8, and the second derivative function is shown in the lower half. As shown in FIG. 8, the design filter function is divided at the points "p" and "q" into three components "A", "B" and "C". Further, the point of the center frequency "fc" on the design filter function is determined. These points "fc", "p" and "q" are selected as being the sample frequency points which are appropriate for interpolation points at which the components "A", "B" and "C" of the transfer function are continuously cascaded one another.

As previously described, in the sound localization filter determining method of the present invention, the filter parameter Q is optimized so as to approximate the desired frequency characteristics such that the difference errors between the desired frequency characteristics and the design filter characteristics only at the sample frequency points are minimized.

Figure 9:
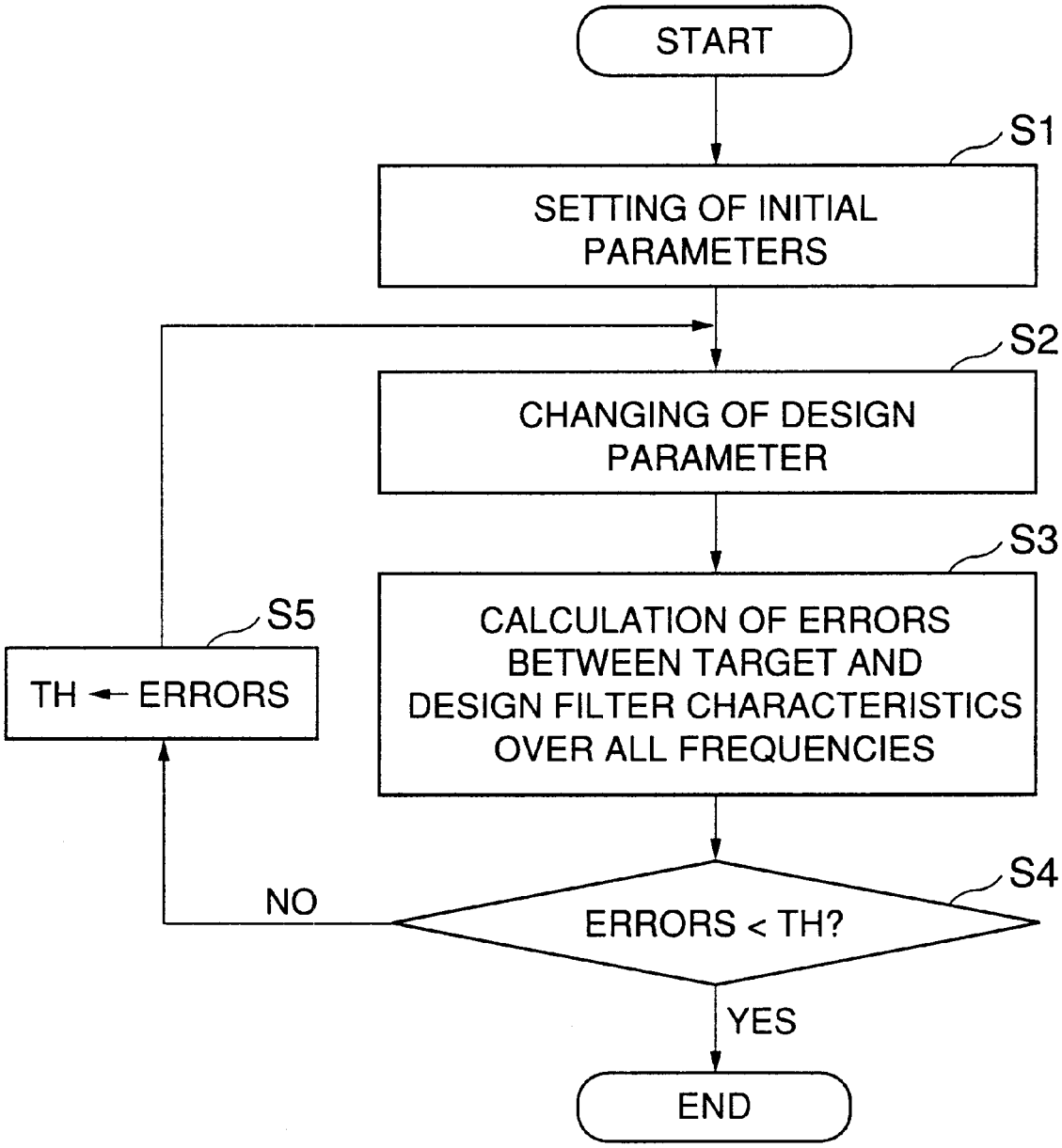
FIG. 9 is a flowchart for explaining calculation of the optimum filter parameter executed by the sound localization filter determining method incorporating the principles of the present invention.

FIG. 9 is a flowchart for explaining calculation of the optimum filter parameter executed by the sound localization filter determining method incorporating the principles of the present invention.

As shown in FIG. 9, at a start of the calculation of the optimum filter parameter, the initial parameters (fc, Q, L) read from the initial parameter memory 35 are set in a parameter memory area of the optimum parameter calculating unit 36 (step S1). The design parameter which is one of the initial parameters (for example, the quality factor Q) is changed (step S2). Difference errors between the target filter characteristics (the desired frequency characteristics) and the design filter characteristics at the sample frequency points are calculated over all the frequencies (step S3). After the step S3 is performed, it is determined whether the difference errors are smaller than a given threshold value TH (step S4).

When the result at the step S4 is negative, the threshold value TH is set to the difference errors (TH <-- ERRORS) (step S5). The above steps S2 through S4 are repeated until the difference errors are smaller than the threshold value TH. When the result at the step S4 is affirmative, it is determined that the optimum filter parameter Q needed to approximate the desired frequency characteristics is obtained. The procedure of the optimum filter parameter calculation shown in FIG. 9 is terminated.

More specifically, the procedure of the optimum filter parameter calculation, executed by the sound localization filter determining method of the present invention, includes the following steps:

(1) the desired frequency characteristics of the head related transfer function are input to the optimum parameter calculating unit 36;

(2) the filter order (n) and the roughly estimated initial parameters (fc, Q, L) are input to the optimum parameter calculating unit 36;

(3) the ranking of the initial parameters is determined by the filter gain L of each initial parameter, and the following steps are performed in order of the ranking:
   - the center frequency fc of the design filter characteristics is aligned with the center frequency fc of the desired frequency characteristics;
   - the filter gain L of the design filter characteristics is aligned with the filter gain L of the desired frequency characteristics; and
   - the quality factor Q of the design filter characteristics is optimized so as to approximate the desired frequency characteristics such that the difference errors between the desired frequency characteristics and the design filter characteristics at the sample frequency points are minimized, (4) when the difference errors are smaller than a given threshold value (for example, 0.1 dB), the optimum filter parameter calculation procedure is terminated.

By performing the above-mentioned optimum filter parameter calculation procedure, the optimum filter parameter needed to approximate the desired frequency characteristics is obtained.

In the system control module 1 of FIG. 7, the plurality of sets of initial parameters (fc, Q, L) (related to each of the S/L filters 12 and 22) for one of predetermined direction angles 0° through 120° with 30-degree increments about the front position of the listener are stored in the initial parameter memory 35. In the initial parameter generating unit 34, the impulse response measurement unit 41 provides measurements of the frequency characteristics of the head related transfer functions (the HRTF-R and HRTF-L) for each of the predetermined direction angles about the front position of the listener, such as those shown in FIG. 2. The parameter extracting unit 42 extracts initial parameters from the measurements of the frequency characteristics supplied by the impulse response measurement unit 41, and supplies the initial parameters to the initial parameter memory 35.

When a localization shift signal is supplied to the CPU 31, one of the sets of initial parameters (fc, Q, L) (which are relevant to the localization shift signal) is read from the initial parameter memory 35 by the CPU 31, and the CPU 31 transmits the initial parameters to the optimum parameter calculating unit 36. The optimum parameter calculating unit 36 calculates the optimum filter parameter based on the transmitted initial parameters through the above-mentioned calculation procedure, and supplies the optimum filter parameter to the filter coefficient determining unit 37. This optimum filter parameter represents an approximation of the desired frequency characteristics of the analog filter. The filter coefficient determining unit 37 determines filter coefficients of each of the S/L filter 12 and the S/L filter 22 based on the supplied optimum filter parameter through the mapping to transform the s-plane into the z-plane. The CPU 31 controls the filter coefficient determining unit 37 such that the determined filter coefficients are supplied from the filter coefficient determining unit 37 to each of the coefficient buffer 13 and the coefficient buffer 23. Hence, the S/L filters 12 and 13 in the sound localization control system of FIG. 6 provide the right-channel and left-channel output signals at their outputs which suit the localization shift signal at the input of the CPU 31.

In the system control module 1 of FIG. 7, when shifting the localized position of the simulated sound source into an intermediate position between the predetermined direction angles is needed, the parameter interpolation calculating unit 38 calculates interpolated parameters based on the initial parameters (fc, Q, L) (which are relevant to the localization shift signal) read from the initial parameter memory 35. The filter coefficient determining unit 37 determines filter coefficients of each of the S/L filter 12 and the S/L filter 22 based on the interpolated parameters supplied by the parameter interpolation calculating unit 38. The CPU 31 controls the filter coefficient determining unit 37 such that the determined filter coefficients are supplied from the filter coefficient determining unit 37 to each of the coefficient buffer 13 and the coefficient buffer 23, so as to suit the localization shift command.

Further, when shifting the localized position of the simulated sound source into an intermediate position between the predetermined direction angles (0° through 120° with 30-degree increments) about the front position of the listener is needed, the parameter interpolation calculating unit 38 calculates interpolated parameters based on the two adjacent initial parameters (which are relevant to the localization shift signal) read from the initial parameter memory 35. The filter coefficient determining unit 37 determines filter coefficients of each of the S/L filter 12 and the S/L filter 22 based on the interpolated parameters supplied by the parameter interpolation calculating unit 38. The CPU 31 controls the filter coefficient determining unit 37 such that the determined filter coefficients are supplied from the filter coefficient determining unit 37 to each of the coefficient buffer 13 and the coefficient buffer 23, so as to suit the localization shift signal.

Accordingly, the sound localization control system incorporating the principles of the present invention is effective in achieving smooth shifting of the localized position of the simulated sound source to another.

The sound localization control system of the present invention is effective in achieving the execution of the cross-fade function with a small size of the hardware. It is possible for the sound localization control system of the present invention to achieve smooth shifting of the localized position of the simulated sound source to another by execution of the cross-fade function with the right-channel and left-channel sound localization filters and the output buffers, and the sound localization control system of the present invention requires only a single IIR filter for one of the right and left channels.

Figure 10:
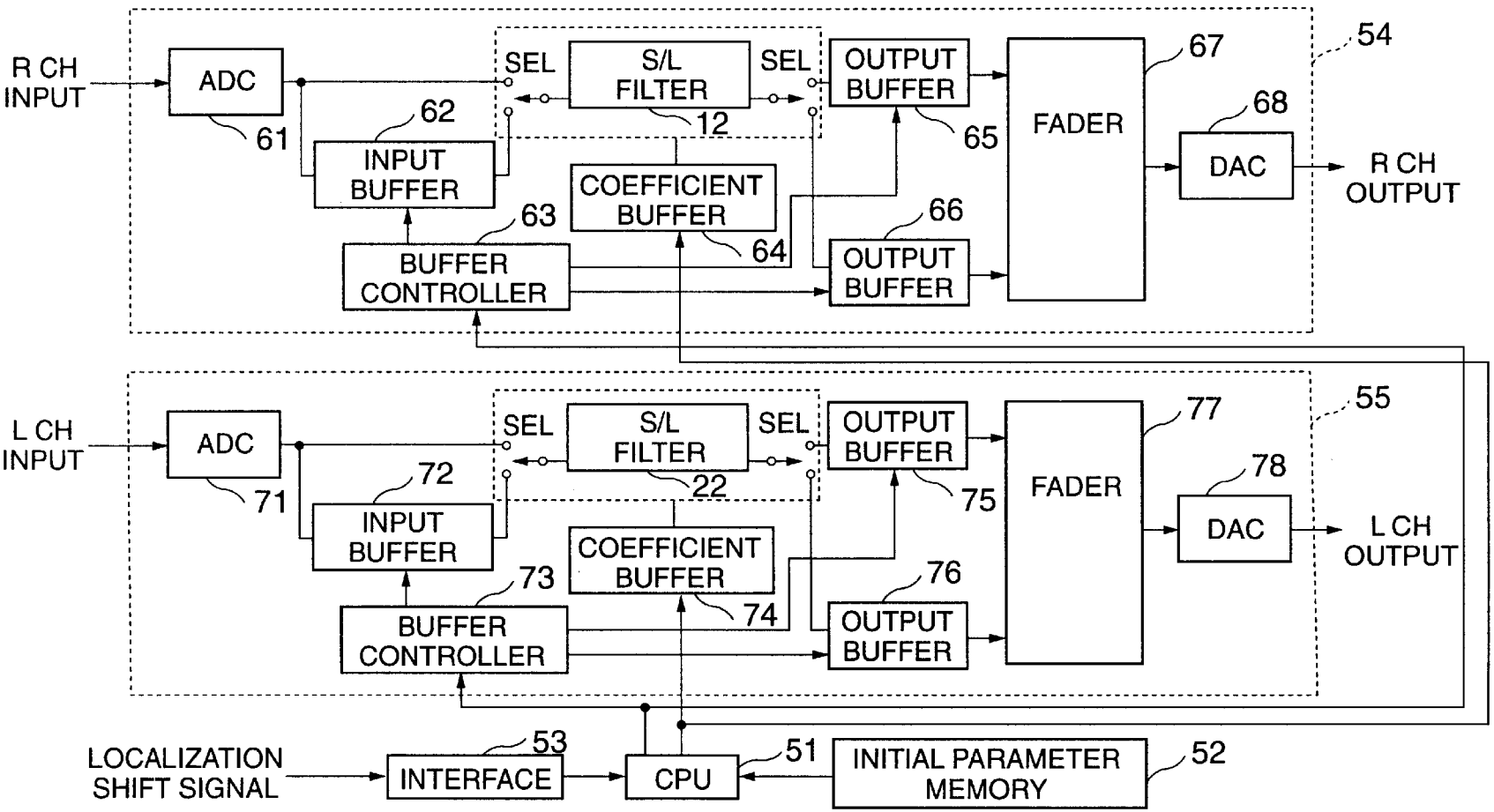
FIG. 10 is a block diagram of a sound localization control system with a cross-fade function incorporating the principles of the present invention.
Figure 11:
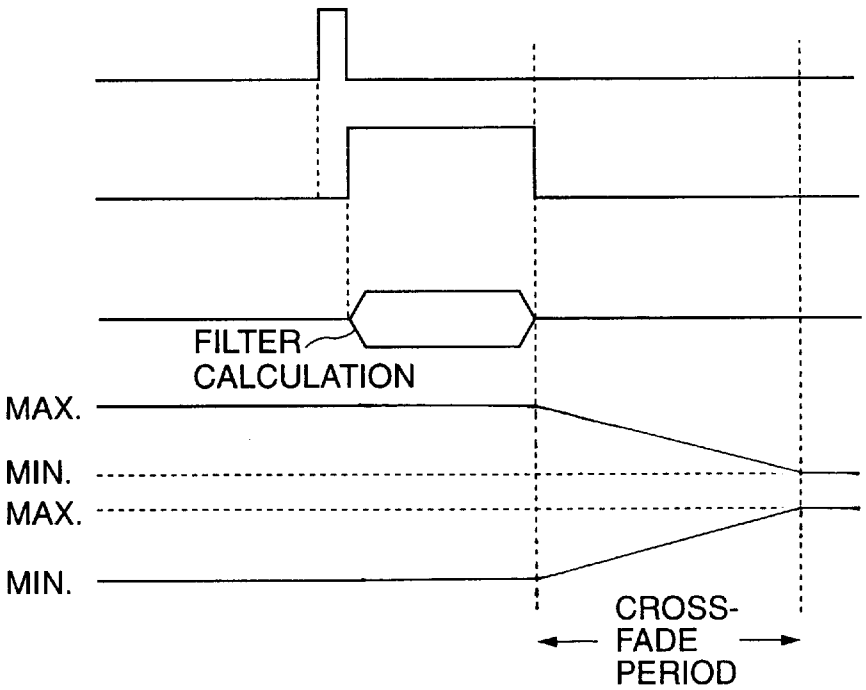
FIG. 11 is a time chart for explaining the cross-fade function of the sound localization control system of FIG. 10.

FIG. 10 shows one embodiment of the sound localization control system with the cross-fade function incorporating the principles of the present invention. FIG. 11 is a flowchart for explaining the cross-fade function of the system of FIG. 10.

As shown in FIG. 10, the sound localization control system of the present embodiment generally has a CPU 51, an initial parameter memory 52, an interface unit 53, a right-channel (R CH) filter module 54, and a left-channel (L CH) filter module 55.

In the sound localization control system of FIG. 10, the CPU 51 controls the entire system. The initial parameter memory 52 stores a plurality of sets of initial parameters, for each of the S/L filters 12 and 22, with respect to a plurality of predetermined direction angles about the front position of the listener as in the embodiment of FIG. 7. A localization shift signal is supplied from an external system through the interface unit 53 into the CPU 51.

For the sake of simplicity of description, the optimum parameter calculating unit 36, the filter coefficient determining unit 37 and the parameter interpolation calculating unit 38 as in the system control module 1 of FIG. 7 are omitted in the embodiment of FIG. 10. Suppose that the CPU 51 in the present embodiment is adapted to incorporate the elements 36 through 38 in the embodiment of FIG. 7 although these elements are omitted in the embodiment of FIG. 10.

The R CH filter module 54 includes an analog-to-digital converter (ADC) 61, an input buffer 62, the S/L filter 12, a buffer controller 63, a coefficient buffer 64, an output buffer 65, an output buffer 66, a fader 67, and a digital-to-analog converter (DAC) 68. The ADC 61 inputs an analog right-channel sound signal (R CH INPUT), and converts the input signal into a digital signal. The ADC 61 supplies the digital signal to the input of the S/L filter 12. The digital signal output by the ADC 61 is temporarily stored in the input buffer 62, and the input buffer 62 supplies the stored digital signal to the input of the S/L filter 12. The S/L filter 12 is comprised of a digital IIR filter determined by the method of the present invention. As shown in FIG. 10, an input selector (SEL) is provided at the input of the S/L filter 12, and an output selector (SEL) is provided at the output of the S/L filter 12. The input selector SEL, the output selector SEL, the input buffer 62 and the output buffers 65 and 66 are controlled by the buffer controller 63. The coefficient buffer 64 stores filter coefficients of the S/L filter 12 transmitted by the CPU 51 in the same manner as that of the embodiment of FIG. 7.

The S/L filter 12 outputs a digital right-channel localized sound signal based on the digital signal at one of the output of the ADC 61 and the output of the input buffer 62 and based on the filter coefficients at the output of the coefficient buffer 64. The right-channel localized sound signal output by the S/L filter 12 is temporarily stored in one of the output buffers 65 and 66. The fader 67 is comprised of two variable attenuators and an adder, and constitutes a part of the cross-fade function. The DAC 68 converts the right-channel localized sound signal, output from the S/L filter 12, into an analog right-channel localized sound signal (R CH OUTPUT).

Further, in the system of FIG. 10, the L CH filter module 55 includes an analog-to-digital converter (ADC) 71, an input buffer 72, the S/L filter 22, a buffer controller 73, a coefficient buffer 74, an output buffer 75, an output buffer 76, a fader 77, and a digital-to-analog converter (DAC) 78.

The ADC 71 inputs an analog left-channel sound signal (L CH INPUT), and converts the input signal into a digital signal. The ADC 71 supplies the digital signal to the input of the S/L filter 22. The digital signal output by the ADC 71 is temporarily stored in the input buffer 72, and the input buffer 72 supplies the stored digital signal to the input of the S/L filter 22. The S/L filter 22 is comprised of a digital IIR filter determined by the method of the present invention. As shown in FIG. 10, an input selector (SEL) is provided at the input of the S/L filter 22, and an output selector (SEL) is provided at the output of the S/L filter 22. The input selector SEL, the output selector SEL, the input buffer 72 and the output buffers 75 and 76 are controlled by the buffer controller 73. The coefficient buffer 74 stores filter coefficients of the S/L filter 22 transmitted by the CPU 51 in the same manner as that of the embodiment of FIG. 7.

The S/L filter 22 outputs a digital left-channel localized sound signal based on the digital signal at one of the output of the ADC 71 and the output of the input buffer 72 and based on the filter coefficients at the output of the coefficient buffer 74. The left-channel localized sound signal output by the S/L filter 22 is temporarily stored in one of the output buffers 75 and 76. The fader 77 is comprised of two variable attenuators and an adder, and constitutes a part of the cross-fade function. The DAC 78 converts the left-channel localized sound signal, output from the S/L filter 22, into an analog left-channel localized sound signal (L CH OUTPUT).

In the above-described embodiment of FIG. 10, when the sound localization control system is in a normal condition (or when no localization shift signal is supplied to the CPU 51), the input and output selectors SEL of the filter 12 are positioned to connect the ADC 61 and the S/L filter 12 and connect the S/L filter 12 and the output buffer 65. Further, in the normal condition of the system, the input and output selectors SEL of the filter 22 are positioned to connect the ADC 71 and the S/L filter 22 and connect the S/L filter 22 and the output buffer 75. A sequence of digital sound signals output by the ADC 61 at the sampling intervals is supplied to the S/L filter 12, and a sequence of digital sound signals output by the ADC 71 at the sampling intervals is supplied to the S/L filter 22. The S/L filters 12 and 22 output the digital right-channel and left-channel localized sound signals to the output buffers 65 and 75. Each of the output buffers 65 and 75 is comprised of a plurality of FIFO-form registers and has a delay equivalent to a given number of sampling periods. The output buffers 65 and 75 output the digital localized sound signals to the faders 67 and 77 with the delay.

Further, when the sound localization control system is in the normal condition, the input buffers 62 and 72 temporarily store the digital sound signal sequences output by the ADC 61 and the ADC 71.

As indicated by (a) in FIG. 11, when a localization shift signal is supplied through the interface unit 53 to the CPU 51 in the embodiment of FIG. 10, the previous filter coefficients, stored in the coefficient buffers 64 and 74, are instantly replaced by new filter coefficients (which are related to the localization shift signal) transmitted by the CPU 51 in the same manner as that of the embodiment of FIG. 7. As indicated by (b) in FIG. 11, at a timing synchronous to the falling edge of the localization shift signal, the CPU 51 sets a selector switch signal in high state (or in ON state) and supplies the signal to the buffer controllers 63 and 73 so as to control the selectors of the filters 12 and 22. The input and output selectors SEL of the filter 12 are switched to connect the input buffer 62 and the S/L filter 12 and connect the S/L filter 12 and the output buffer 66, and the input and output selectors SEL of the filter 22 are switched to connect the input buffer 72 and the S/L filter 22 and connect the S/L filter 22 and the output buffer 76.

As indicated by (c) in FIG. 11, the S/L filters 12 and 22 instantly generate the digital right-channel and left-channel localized sound signals based on the digital sound signal sequences previously stored in the input buffers 62 and 72 and based on the new filter coefficients stored in the coefficient buffers 64 and 74. The calculation of the localized sound signals based on the new filter coefficients is performed by the S/L filters 12 and 22 with the input buffers 62 and 72, and it does not depend on the sampling period of the ADC 61 and 71. As shown in FIG. 11, the calculation of the localized sound signals can be speedily performed by the S/L filters 12 and 22. Then the S/L filters 12 and 22 supply such signals to the output buffers 66 and 76. Each of the output buffers 66 and 76 is comprised of a plurality of FIFO-form registers and has a delay equivalent to a given number of sampling periods. The output buffers 66 and 76 output the digital localized sound signals to the faders 67 and 77 with the delay. As indicated by (b) in FIG. 11, at the end of the calculation of the localized sound signals, the CPU 51 sets the selector switch signal in low state (or in OFF state) and supplies the signal to the buffer controllers 63 and 73 so as to control the selectors of the filters 12 and 22 such that they are set in the original condition.

In the sound localization control system of FIG. 10, the previous-coefficient-based localization sound signals are stored in the output buffers 65 and 75, and the new-coefficient-based localization sound signals are stored in the output buffers 66 and 76. Both the previous and new localized sound signals are supplied to each of the faders 67 and 77. Hence, when the localization shift signal is supplied, the faders 67 and 77 serve to make the previous-coefficient-based localization sound signals to fade out within a cross-fade period and to simultaneously make the new-coefficient-based localization sound signals to fade in within the cross-fade period as indicated by (d) and (e) in FIG. 11.

Accordingly, it is possible for the sound localization control system of the present embodiment to achieve smooth shifting of the localized position of the simulated sound source to another by execution of the cross-fade function with the right-channel and left-channel S/L filters and the output buffers, and the sound localization control system of the present embodiment requires only a single IIR filter for one of the right and left channels. Further, the sound localization control system of the present embodiment is effective in achieving the execution of the cross-fade function with a small size of the hardware.

Further, the present invention is not limited to the above-described embodiments, and variations and modifications may be made without departing from the scope of the present invention.

What is claimed is:

1. A method of determining a sound localization filter for approximation of a head related transfer function, comprising:

storing a plurality of sets of initial parameters with respect to a plurality of predetermined direction angles about a front position of a listener into a memory;

reading one of the sets of initial parameters from the memory in accordance with a localization shift signal;

calculating an optimum filter parameter based on the read initial parameters, the optimum filter parameter needed to approximate desired frequency characteristics of the head related transfer function;

determining filter coefficients of the sound localization filter based on the optimum filter parameter; and supplying the determined filter coefficients to a coefficient buffer provided for the sound localization filter.

2. The method of claim 1, further comprising a step of calculating interpolated parameters based on the initial parameters read from the memory in accordance with the localization shift signal when shifting a localized position of a simulated sound source into an intermediate position between the predetermined direction angles about the front position of the listener is requested by the localization shift signal.

3. The method of claim 1, further comprising steps of:

providing, prior to said storing step, measurements of frequency characteristics of the head related transfer function for each of the predetermined direction angles about the front position of the listener;

extracting initial parameters from the measurements of the frequency characteristics; and supplying the initial parameters to the memory, so that the plurality of sets of initial parameters with respect to each of the predetermined direction angles about the front position of the listener are stored in the memory.

4. The method of claim 1, wherein said calculating step including:

selecting a set of sample frequency points from a design filter transfer function; and changing a filter parameter which is one of the initial parameters so as to approximate the desired frequency characteristics such that difference errors between the desired frequency characteristics and design filter characteristics at the sample frequency points are minimized.

5. The method of claim 1, wherein said calculating step includes:

inputting desired frequency characteristics of the head related transfer function, the desired frequency characteristics being represented by a center frequency, a filter gain and a quality factor;

inputting a filter order and roughly estimated initial parameters;

determining ranking of the initial parameters by a filter gain of each initial parameter;

aligning a center frequency of design filter characteristics with the center frequency of the desired frequency characteristics;

aligning a filter gain of the design filter characteristics with the filter gain of the desired frequency characteristics; and optimizing a quality factor of the design filter characteristics so as to approximate the desired frequency characteristics through an optimum filter parameter calculation such that the difference errors between the desired frequency characteristics and the design filter characteristics at sample frequency points are minimized; and terminating the optimum filter parameter calculation when the difference errors are smaller than a threshold value.

6. A sound localization control system which shifts a localized position of a simulated sound source relative to a front position of a listener into a desired position in response to a localization shift signal and has a cross-fade function, comprising:

a sound localization filter which inputs a sound signal and generates a localized sound signal based on filter coefficients and on the input sound signal, the filter having an input selector and an output selector;

an input buffer which temporarily stores the input sound signal;

a coefficient buffer which stores the filter coefficients of the filter;

a first output buffer which temporarily stores the localized sound signal output by the filter when the filter is connected to the first output buffer via the output selector;

a second output buffer which temporarily stores the localized sound signal output by the filter when the filter is connected to the second output buffer via the output selector;

a fader, connected to the first and second output buffers, which provides the cross-fade function of the localized sound signals output from the first and second output buffers; and a control unit which replaces the filter coefficients stored in the coefficient buffer, with new filter coefficients by transmitting the new filter coefficients to the coefficient buffer when a localization shift signal is received, the control unit controlling the input and output selectors of the filter so as to connect the input buffer and the filter and connect the filter and one of the first and second output buffers, wherein the filter generates a new localized sound signal based on the sound signal stored in the input buffer and on the new filter coefficients stored in the coefficient buffer, and supplies the new localized sound signal to said one of the first and second output buffers via the output selector, the first and second output buffers outputting the localized sound signal and the new localized sound signal to the fader.

7. The sound localization control system of claim 6, further comprising an initial parameter memory connected to the control unit which stores a plurality of sets of initial parameters, for the filter, with respect to a plurality of predetermined direction angles about the front position of the listener.

8. The sound localization control system of claim 7, wherein the control unit includes an optimum parameter calculating unit which calculates an optimum filter parameter based on the initial parameters read from the initial parameter memory in accordance with the localization shift signal.

9. The sound localization control system of claim 8, wherein the control unit includes a filter coefficient determining unit which determines filter coefficients of the filter based on the optimum filter parameter supplied by the optimum parameter calculating unit, the control unit controlling the filter coefficient determining unit so that the determined filter coefficients are supplied from the filter coefficient determining unit to the coefficient buffer.

10. The sound localization control system of claim 7, wherein the control unit includes a parameter interpolation calculating unit which calculates interpolated parameters based on the initial parameters read from the initial parameter memory, when shifting the localized position of the simulated sound source into an intermediate position between the predetermined direction angles is requested by the localization shift signal.

11. The sound localization control system claim 6, wherein the sound localization filter is constituted by a digital IIR filter.

* * * * *